United States Patent [19]

Fukunaga

[11] Patent Number: 4,856,142

[45] Date of Patent: Aug. 15, 1989

[54] HINGE STRUCTURE WITH TORSION BARS

[75] Inventor: Takahiro Fukunaga, Nara, Japan

[73] Assignee: Sharp Kabushiki Kaisha, Osaka, Japan

[21] Appl. No.: 309,902

[22] Filed: Feb. 7, 1989

Related U.S. Application Data

[63] Continuation of Ser. No. 193,154, May 5, 1988, abandoned, which is a continuation of Ser. No. 927,854, Nov. 6, 1986, abandoned.

[30] Foreign Application Priority Data

| | | | |
|---|---|---|---|
| Nov. 13, 1985 | [JP] | Japan | 60-176552[U] |
| Nov. 13, 1985 | [JP] | Japan | 60-176553[U] |
| Nov. 13, 1985 | [JP] | Japan | 60-176554[U] |
| Nov. 13, 1985 | [JP] | Japan | 60-176555[U] |

[51] Int. Cl.[4] ..... E05F 1/12

[52] U.S. Cl. ..... 16/298; 16/308; 16/255; 296/76; 220/335; 220/264; 355/25; 355/75; 267/154

[58] Field of Search ..... 16/289, 297, 298, 308, 16/75, 255, 374; 267/154, 273, 277, 283, 285; 280/700, 721; 49/386; 296/76; 220/335, 264; 355/25, 75

[56] References Cited

U.S. PATENT DOCUMENTS

| | | | |
|---|---|---|---|
| 2,602,957 | 7/1952 | Anderson | 49/386 |
| 2,894,277 | 7/1959 | Bogater et al. | 16/298 |
| 3,498,207 | 3/1970 | Hazen | 16/308 |
| 4,419,789 | 12/1983 | Matsui et al. | 16/308 |

*Primary Examiner*—Nicholas P. Godici
*Assistant Examiner*—Edward A. Brown
*Attorney, Agent, or Firm*—Flehr, Hohbach, Test, Albritton & Herbert

[57] ABSTRACT

A hinge structure by which an upper unit of a housing can open and close with respect to its lower unit around its edge includes two elastic bars twisting around each other. The elastic forces of these bars are set according to the shearing stress applied to them. Contact pieces may be provided to vary their elastic forces when the units are assembled together. Screws may be further provided to vary the twisting angles of the bars to adjust their elastic forces.

2 Claims, 4 Drawing Sheets

HINGE STRUCTURE WITH TORSION BARS

This is a continuation of application Ser. No. 193,154 filed May 5, 1988, now abandoned, and which is a continuation of application Ser. No. 927,854 filed Nov. 6, 1986, now abandoned.

BACKGROUND OF THE INVENTION

This invention relates to a hinge structure with torsion bars and more particularly to a hinge structure for a device which is separable into an upper unit and a lower unit in such a way that a biasing force is applied to the upper unit in the direction of opening it with respect to the lower unit.

Many devices containing component parts which require maintenance work have a housing which is separable into an upper unit and a lower unit such that the upper unit can be opened and closed with respect to the lower unit around an axis at one of its edges. An electrophotographic copying machine with a housing of this type is described in U.S. Pat. No. 4,416,536, issued Nov. 22, 1983 and assigned to the present assignee (and incorporated herein by reference). Since the upper unit of such a housing frequently contains many parts, its weight can be considerable. In order to prevent such an upper unit from dropping down by its own weight while an operator is engaged in a maintenance work, the housing is frequently provided with means for applying elastic biasing forces which tend to keep the upper unit in its opened position. For improving the stability of motion for the upper unit, such biasing forces are usually applied near the ends in the axial direction of the opening and closing motion. Hinge structures with torsion bars as described, for example, in U.S. patent application Ser. No. 785,216 assigned to the present assignee (and also herein incorporated by reference) are sometimes used for this purpose because of their advantageously simple structure and low cost. The hinge structure includes two elongated pieces of elastic material (torsion bars) such that identical elastic forces are applied at the both end sections in the axial direction of the opening and closing motion. If the weight distribution of the upper unit is not uniform because of the positioning of the component parts contained therein, however, there appears a difference in the load on each of the torsion bars. Since the two torsion bars are intended to provide identical forces, a difference in load results in a shearing stress on the upper unit. In order to protect the unit against such a shearing stress, its rigidity must be increased and this means an increase in cost.

It may be considered to use compressive springs for the same purpose such that the elastic forces can be easily varied, depending on the load to be supported. If the weight distribution of the upper unit is not uniform, however, springs of different sizes must be provided on both end sections in order to eliminate the shearing stress on the upper unit. This results in an increased number of component parts. Moreover, changes in the elastic force of the springs necessitate readjustments of component parts and this, too, has the effect of increased cost.

SUMMARY OF THE INVENTION

It is an object of the present invention to provide a compact and inexpensive hinge structure with torsion bars for a device with upper and lower units such that a biasing force is applied to the upper unit in the direction of opening it with respect to the lower unit.

It is another object of the present invention to provide such a hinge unit with which shearing stress on the upper unit caused by its uneven weight distribution can be eliminated.

It is still another object of the present invention to provide a hinge structure with torsion bars which can be attached easily to units which are intended to be opened and closed with respect to each other.

It is a further object of the present invention to provide a hinge structure with torsion bars for opening and closing an upper unit of a housing with respect to its lower unit around an axis such that forces at the both end sections of the axis of rotation can be adjusted.

The above and other objects of the present invention are achieved by providing a hinge structure with two torsion bars with different elastic forces according to the shearing stress exerted on each of them. With a hinge structure of this type, an inexpensive and compact torsion bar system can be utilized and their elastic forces are adjusted so as to eliminate shearing stress on the upper unit caused by its unbalanced weight distribution.

Attachment of such a hinge structure to a device is simplified according to the present invention by making use of the fact that the elastic force of a torsion bar increases nearly in proportion to its twisting angle (angular displacement). Protruding contacting pieces are provided such that the twisting angles of torsion bars are increased when the upper and lower units are assembled together. In other words, the twisting angles are small when the hinge structure is attached to one of the units but can be increased when the units are assembled together. This makes the attachment work much easier, obviating the need to increase rigidity of the attachment pieces.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figure 1:
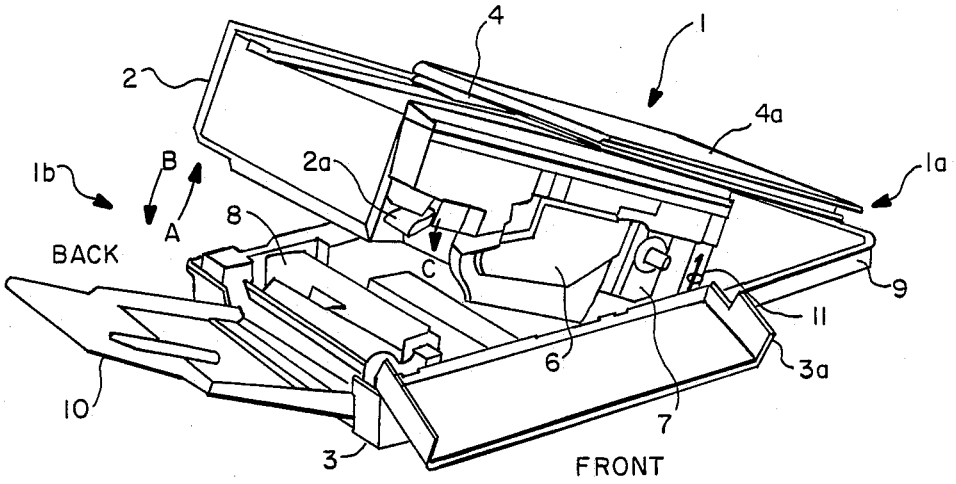
FIG. 1 is an external view of an electrophotographic copying machine provided with a hinge structure with torsion bars according to the present invention when the upper unit of the copying machine is in opened condition.

In what follows, an embodiment of the present invention is described by way of its application to an electrophotographic copying machine. FIG. 1 is an external view of such an electrophotographic copying machine 1 provided with a hinge structure with torsion bars according to the present invention when its upper unit is opened by means of this hinge structure.

The electrophotographic copying machine 1 is basically so structured that it is divisible into an upper unit 2 and a lower unit 3 along a plane which includes a paper transport route from a paper supply side surface 1*a* to a paper discharge side surface 1*b* such that internal component parts can be maintained and jammed sheets of paper can be removed easily. The upper unit 2 which is positioned above the paper transport route includes an original document table 4 such that it can undergo reciprocating motion together with a document cover 4*a*. Inside the upper unit 2, there are a photo sensitive device 6, a developing device 7 and the like. The photosensitive device 6 includes a rotatably disposed photosensitive body belt and the developing device 7 serves to supply developing agent to the surface of this belt. In addition, though not shown in FIG. 1, an optical unit, driving means, driving force communicating means and the like are provided inside the upper unit 2. Since heavy components such as the driving means and the driving force communicating means are at the back part of the upper unit 2, weight distribution of the upper unit 2 is far from uniform, the back part being heavier than the front part.

The lower unit 3 includes a fixing device 8 and paper transfer means (not shown). A paper cassette 9 is provided on the paper supply surface 1*a* of the lower unit 3 and a paper discharge tray 10 is likewise provided on its paper discharge side surface 1*b*. A cover 3*a* on the front side of the lower unit 3 can be opened in the outwardly direction around a hinge along its lower edge. When this cover 3*a* is opened, the photosensitive device 6 and the developing device 7 of the upper unit 2 become exposed.

The upper unit 2 can be opened and closed with respect to the lower unit 3 around the paper supply side surface 1*a* as shown by arrows A and B. A torsion bar system 11 is provided inside the copier 1 near its paper supply side surface 1*a* so as to apply a biasing force to keep the upper unit 2 in its opened position, or in the direction of the arrow A. A lock lever 2*a* is provided near the paper discharge side surface 1*b* of the upper unit 2. When the upper unit 2 is closed, it is kept in its closed condition by a locking mechanism which is not shown. When it is desired to open the upper unit 2 in the direction of the arrow A, the lock lever 2*a* is operated in the direction of the arrow C to release the locking mechanism. When this is done, the upper unit 2 opens in the direction of the arrow A by the elastic force of the torsion bar system 11. The upper unit 2 is closed by pressing it in the direction of the arrow B against the elastic force of the torsion bar system 11. The upper unit 2 can be closed easily because the weight of the upper unit 2 itself tends to help this motion.

Figure 2:
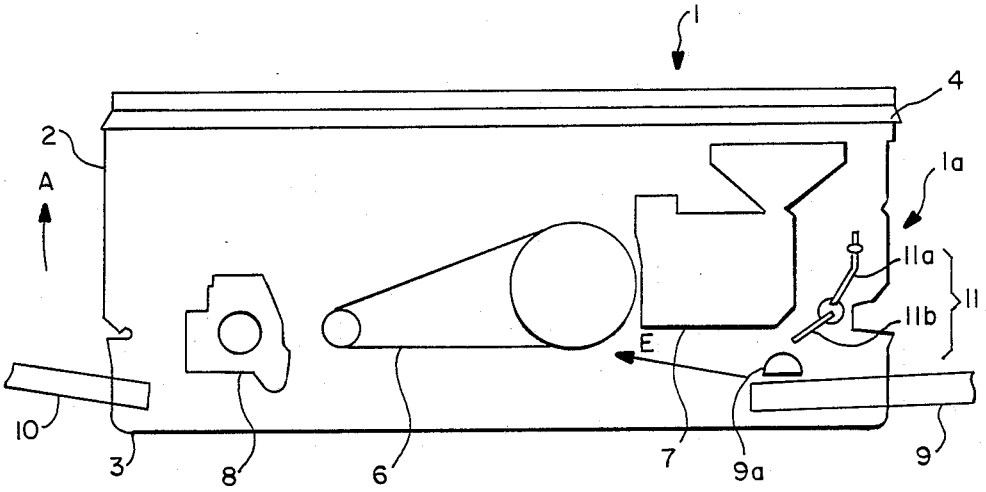
FIG. 2 is a schematic front view of the copying machine of FIG. 1 in its closed condition.

FIG. 2 is a schematic front view of the copying machine of FIG. 1 equipped with the aforementioned hinge structure with torsion bars. When the upper unit 2 is in the closed condition, the interior of the copying machine 1 may appear as shown in FIG. 2. An electrostatic image of an original document on the document table 4 is formed on the photosensitive body belt disposed nearly at the center and a patent image is formed therefrom with developing agent supplied from the developing device 7. A sheet of copy paper is transported by the rotation of a paper supply roller 9*a* in the direction of the arrow E from the paper cassette 9 attached to the lower unit 3 and the patent image on the photosensitive body belt is transferred thereonto. This paper passes through the fixing device 8 and is discharged into the discharge tray 10.

When the upper unit 2 is opened in the direction of the arrow A, the paper transport route along which copy paper passes inside the copying machine 1 becomes exposed. The torsion bar system 11 disposed near the paper supply side surface 1*a* comprises two elastic elongated pieces (torsion bars) 11*a* and 11*b*. The first torsion bar 11*a* is attached to the front side of the upper unit 2 and the back side of the lower unit 3. The second torsion bar 11*b* is likewise attached to the back side of the upper unit 2 and the front side of the lower unit 3.

Figure 3B:
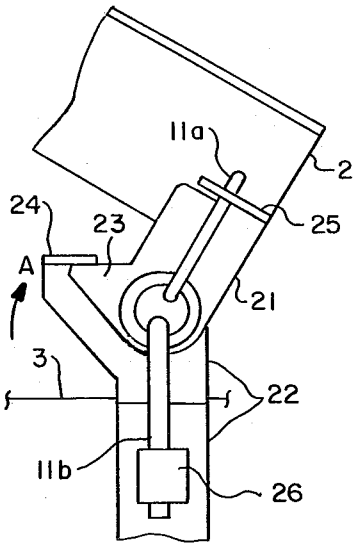
FIGS. 3A and 3B are side and front views of a hinge structure with torsion bars embodying the present invention when it is in opened condition.
Figure 3A:
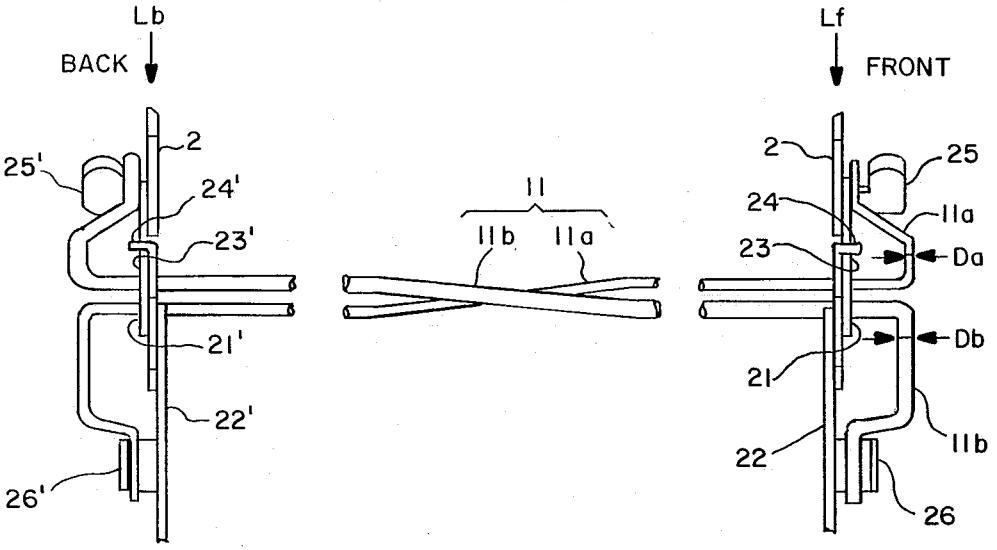

An example of hinge structure with torsion bars embodying the present invention is described next by way of FIGS. 3A and 3B, FIG. 3A being its side view and FIG. 3B being its front view. The two torsion bars 11*a* and 11*b* are in contact with and cross each other at their center sections and they are provided with metallic upper attachment pieces 21 and 21′ and lower attachment pieces 22 and 22′. The pieces 21 and 22′ attach the torsion bar 11*a* to the upper and lower units 2 and 3, respectively, and the pieces 21′ and 22 attach the torsion bar 11*b* to the upper and lower units 2 and 3, respectively. The upper attachment pieces 21 and 21′ have protruding parts 23 and 23′ and stopping parts 25 and 25′. The lower attachment pieces 22 and 22′ have stopping parts 26 and 26′ and curved parts 24 and 24′. Each of the protruding parts 23 and 23′ of the upper attachment pieces 21 and 21′ touches one of the curved parts 24 and 24′ of the lower attachment pieces 22 and 22′. The both ends of the torsion bars 11*a* and 11*b* are affixed to the stopping parts 25, 25′, 26 and 26′ as shown.

As mentioned above, weight distribution of the upper unit 2 is not uniform because of the manner in which various components are attached to its interior. For this reason, the load $L_f$ applied to the upper attachment piece 21 at the front side of the upper unit 2 is smaller than the load $L_b$ applied to the piece 21′ at its back side. For this reason, the diameter $D_a$ of the torsion bar 11*a* supported by the piece 21 at the front side is made smaller than the diameter $D_b$ of the torsion bar 11*b* supported by the piece 21′ at the back side. In other words, the elastic force of the torsion bar 11*b* is greater than that of the torsion bar 11*a*. More particularly, the torsion bars 11*a* and 11*b* are each designed to have an elastic force determined by the load expected to be applied thereon.

In summary, this embodiment of the present invention teaches the use of two torsion bars having different diameters $D_a$ and $D_b$ such that the two torsion bars have different elastic forces according to the loads $L_f$ and $L_b$ which are applied individually to the torsion bars. The occurrence of shearing force on the upper unit 2 caused by the uneven weight distribution can thus be prevented and the need for reinforcing the unit, etc. can be obviated. It now goes without saying that different elastic forces of the two torsion bars may be caused by using different materials for them, instead of designing them with different diameters.

Figure 4:
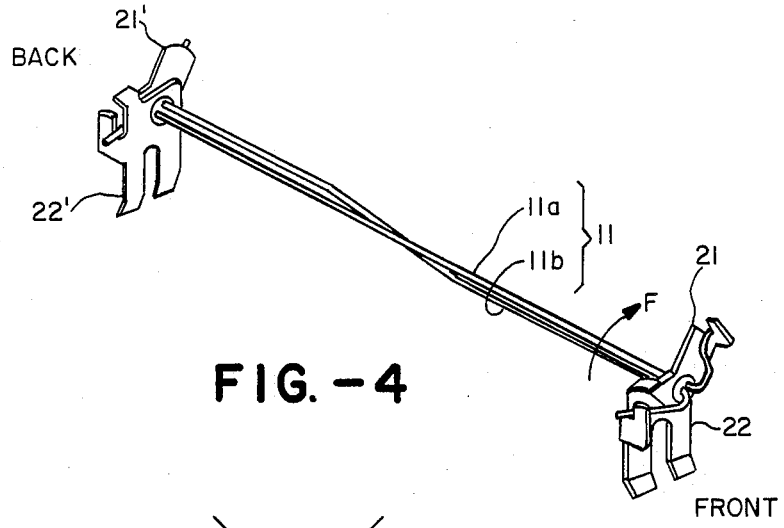
FIG. 4 is a perspective view of a torsion bar system according to the present invention.

FIG. 4 is a perspective view of the torsion bars 11*a* and 11*b* with their attachment metals 21, 21', 22 and 22' assuming positions when a force F is applied to the upper unit.

It is not a simple matter to install the torsion bar system of FIG. 4 in a device. According to a conventional procedure, the torsion bars are first attached either to the upper unit or to the lower unit and then the units are assembled together. In this situation, the torsion bars are held by attachment pieces and then these attachment pieces are fastened to supporting pieces affixed to the other unit. This, however, is not a satisfactory method because a sufficiently strong elastic force must be supplied to open the upper unit when the torsion bar system is attached to either of the units. This means that rigidity of the attachment pieces must be increased to withstand the large elastic force. In another aspect of the present invention, a hinge structure with torsion bars is provided which can be attached easily to the units.

Figure 5B:
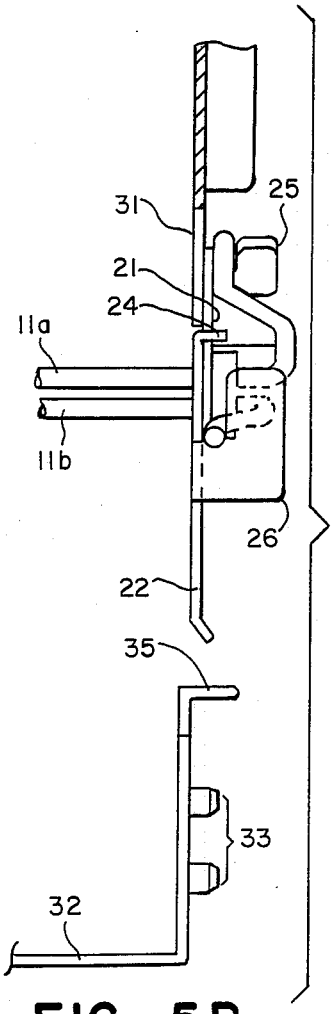
FIGS. 5A and 5B are front and side views of a hinge structure with torsion bars after it is attached to one of the units but before it is attached to the other unit.
Figure 5A:
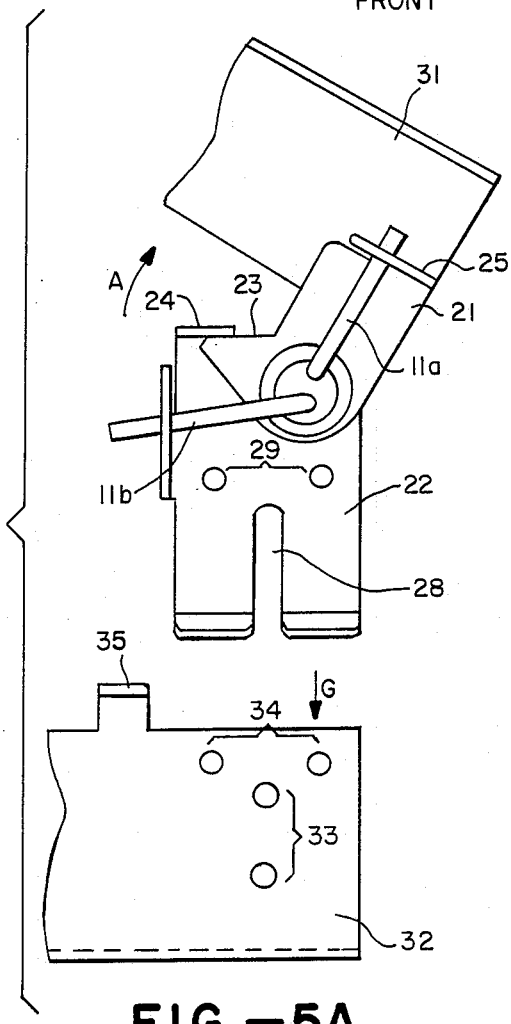

FIGS. 5A and 5B are, respectively, a front view and a side view of a torsion bar system, its attachment pieces and its supporting pieces embodying the present invention. Components which are identical or equivalent to those already described and explained above are indicated by identical numerals.

The upper attachment piece 21 to be attached to a upper unit frame 31 has a stopping part 25 to which the front end of the torsion bar 11*a* is fastened. The lower attachment piece 22 to be attached to a lower unit frame 32 has a similar stopping part 26 to which the front end of the other torsion bar 11*b* is fastened. The upper attachment piece 21 is provided with a protruding part 23 and the lower attachment piece 22 is provided with a curved part 24. If the upper attachment piece 21 rotates in the direction of the arrow A with respect to the lower attachment piece 22, the protruding part 23 hits the curved part 24 to stop the rotational motion.

Figure 6B:
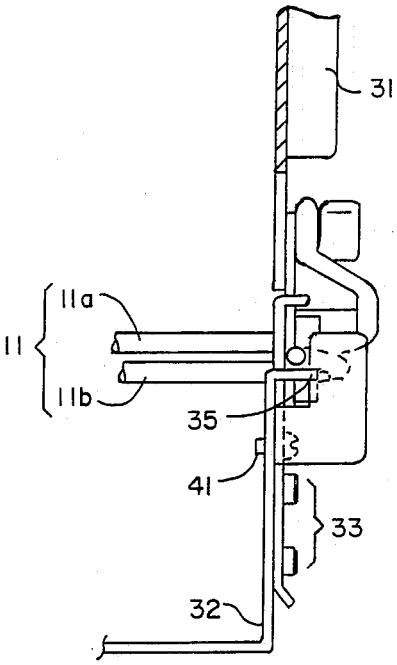
FIGS. 6A and 6B are front and side views of the hinge structure of FIGS. 5A and 5B after it is attached to both the upper and lower units of a device.
Figure 6A:
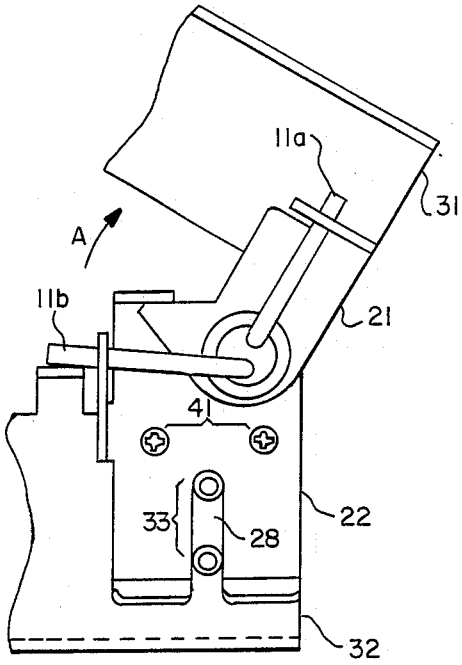

A slit 28 opening to the downward direction is formed in the lower attachment piece 22. Two holes 29 are also provided near the center of the lower attachment piece 22. Two protruding pieces 33 are provided in vertical relationship with respect to each other on the part of a lower unit frame 32 where the lower attachment piece 22 is to be attached. Additionally, there are two screw holes 34 provided in horizontal relationship to each other on the lower unit frame 32. The lower unit frame 32 is further provided with a protruding contact piece 35 at the top edge. The lower attachment piece 22 is affixed to the lower unit frame 32 by starting from their relative positions as shown in FIG. 5A and moving the lower attachment piece 22 in the direction of the arrow G to insert the protruding pieces 33 through the slit 28. When the holes 29 come to coincide with the positions of the screw holes 34, screws are inserted to fasten the upper attachment piece 22 to the lower unit frame 32. FIGS. 6A and 6B are respectively a front view and a side view of the hinge structure of FIGS. 5A and 5B when the upper and lower unit 2 and 3 have been assembled together. Numeral 41 indicates the screws inserted into the screw holes 34 to fasten the lower attachment piece 22 to the lower unit frame 32. When this is done, the protruding contact piece 35 on the lower unit frame 32 comes into contact with the end of the torsion bar 11*b*, pushing it upward to increase the twisting angle of the torsion bar 11*b* and thereby increasing its elastic force in the direction of the arrow A. The upper attachment piece 21' and lower attachment piece 22' on the back sides are similarly structured. The lower unit frame 32 is also structured similarly on the back side. Thus, the back end part of the torsion bar 11*a* also becomes pushed upward, increasing its twisting angle and hence its elastic force.

With the attachment and supporting pieces structured as explained above and shown in FIGS. 5A and 5B two torsion bars 11*a* and 11*b* are positioned as shown in FIG. 4 and are initially supported by the upper attachment pieces 21 and 21' and the lower attachment pieces 22 and 22'. Thereafter, the upper attachment pieces 21 and 21' are affixed to the upper unit frame 31 of the copying machine. Lastly, the upper unit 2 and the lower unit 3 are assembled together by affixing the lower attachment pieces 22 and 22' to the lower unit frame 32. In short, since the two torsion bars 11*a* and 11*b* are kept as a single unit with the attachment pieces 21, 21', 22 and 22' as shown in FIG. 4, there is no need to maneuver the torsion bars when they are affixed to the units 2 and 3, thus simplifying the process. Moreover, since protruding contact pieces push the torsion bars to increase their twisting angles and hence their elastic forces when the lower attachment pieces are affixed to the lower unit frame, sufficient elastic force can be obtained from the torsion bar system. In other words, the elastic force of the torsion bar system before the lower attachment pieces are affixed to the lower unit frame is allowed to be smaller than when these torsion bars are required to show their full strength. As a result, rigidity of the lower attachment pieces need not be increased and this leads to reduced cost and reduced size of the product.

Figure 7A:
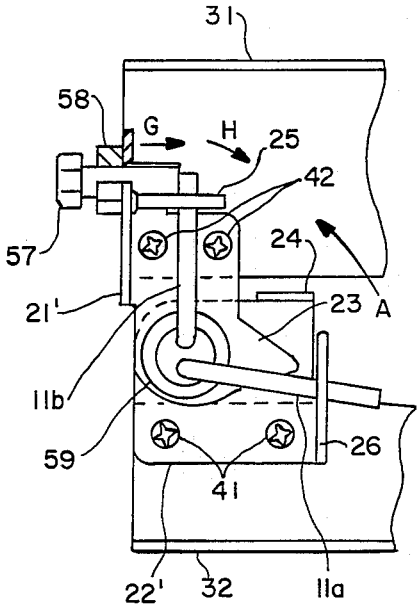
FIGS. 7A and 7B are back and side views of a hinge structure with torsion bars according to another embodiment of the present invention.
Figure 7B:
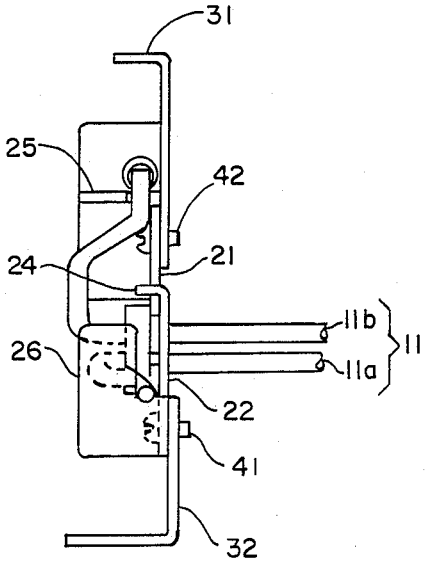

FIGS. 7A and 7B are respectively a back view and a side view of still another embodiment of the present invention. Numeral 59 indicates a boss around which the upper attachment piece 21' and the lower attachment piece 22' are rotatable with respect to each other. The upper attachment piece 21' is affixed to the upper unit frame 31 by screw means 42 and the lower attachment piece 22' is affixed to the lower unit frame 32 by screw means 41. As shown in FIG. 7A, the upper attachment piece 21' has a stopping part 25 to which an end of the torsion bar 11*b* is fastened and the lower attachment piece 22' has a stopping part 26' to which an end of the torsion bar 11*a* is fastened. A protruding part 23' of the upper attachment piece 21' is in contact with a curved part 24' of the lower attachment piece 22' so as to limit the rotational motion of the upper unit frame 31 and the upper attachment piece 21' in the direction of the arrow A.

According to this embodiment of the present invention, an adjusting screw 57 is provided such that its effective length is variable. This screw 57 is positioned with respect to the upper attachment piece 21 by means of a lock nut 58. The end of the screw 57 is in contact with the end of the torsion bar 11*b* such that the end of the torsion bar 11*b* is moved in the direction of the arrow H if the screw 57 is rotated and advances in the direction of the arrow G. This causes the twisting angle of the torsion bar 11*b* to increase and hence to also increase its elastic force in the direction of the arrow A.

In this manner, the force exerted on the back part of the upper unit can be increased, depending on the distribution of weight of the upper unit, and the shearing force on the upper unit can be counterbalanced.

The foregoing description of a preferred embodiment of the present invention has been presented for purposes of illustration and description. It is not intended to be exhaustive or to limit the invention to the precise form disclosed, and obviously many modifications and variations are possible in light of the above teaching. For example, the present invention can be applied to devices other than an electrophotographic copying machine of which an upper unit can be opened and closed with respect to a lower unit. Although FIGS. 7A and 7B disclose an embodiment wherein an adjustment screw is provided to the upper attachment piece on the back side, a similar adjustment screw may be provided to the upper attachment piece on the front side. Moreover, nothing prevents from providing such screws to both upper attachment pieces. If necessary, lower attachment pieces, too, may be made adjustable similarly. Regarding the method of attaching torsion bars to units, furthermore, the lower attachment pieces may be attached to the lower unit frame before the upper attachment pieces are attached to the upper unit frame. In order to further simplify the work of attaching a torsion bar to attachment pieces, the elastic force of the torsion bar system may be made weaker than the value corresponding to the lighter of the loads on the upper unit and protruding contact pieces are provided to both of the torsion bars such that their twisting angles are increased by different amounts. Such modifications and variations which may be apparent to a person skilled in the art are intended to be included within the scope of this invention.

What is claimed is:

1. In a hinged structure for a housing, said housing having an upper unit and a lower unit which are connected to each other such that said upper unit can be rotationally opened and closed with respect to said lower unit around an axis at an edge of said upper unit, a torsion bar means applying a biasing force to said upper unit in the direction of opening said upper unit, the improvement wherein said torsion bar means comprises two elongated elastic members each twisting by an angle, said hinge structure including attachment pieces adapted to be attached individually to said upper and lower units and stopping pieces for attaching said elongated elastic members individually to said attachment pieces, one of said units having contact pieces which are so formed that, if said hinge structure is attached to the other of said units and said units are thereafter assembled together, said contact pieces come onto contact individually with and push end parts of said elongated elastic members to thereby increase said angles and increase the elastic force of said torsion bar means.

2. The hinge structure of claim 1 wherein said elastic members are mutually in contact and twist around each other at center sections thereof.

* * * * *